US011371663B2

(12) United States Patent
Pyshos

(10) Patent No.: US 11,371,663 B2
(45) Date of Patent: Jun. 28, 2022

(54) LIGHT BULB SHAPED LIGHT EMITTING DIODE MODULE

(71) Applicant: SIGNIFY HOLDING B.V., Eindhoven (NL)

(72) Inventor: Steven Walter Pyshos, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 1 day.

(21) Appl. No.: 16/792,784

(22) Filed: Feb. 17, 2020

(65) Prior Publication Data

US 2020/0263838 A1 Aug. 20, 2020

Related U.S. Application Data

(60) Provisional application No. 62/807,178, filed on Feb. 18, 2019.

(51) Int. Cl.

| | |
|---|---|
| ***F21K 9/235*** | (2016.01) |
| ***F21V 19/00*** | (2006.01) |
| ***H05B 45/10*** | (2020.01) |
| ***H05B 45/20*** | (2020.01) |
| ***F21V 23/06*** | (2006.01) |
| ***F21V 23/04*** | (2006.01) |
| ***F21V 23/00*** | (2015.01) |

(52) U.S. Cl.

CPC ..... *F21K 9/235* (2016.08); *F21V 19/003* (2013.01); *F21V 23/003* (2013.01); *F21V 23/04* (2013.01); *F21V 23/06* (2013.01); *H05B 45/10* (2020.01); *H05B 45/20* (2020.01)

(58) Field of Classification Search

CPC ..... F21V 19/003; F21V 23/04; H05B 45/10; H05B 45/20; F21K 9/20–238

See application file for complete search history.

(56) References Cited

U.S. PATENT DOCUMENTS

| | | | | |
|---|---|---|---|---|
| 5,160,201 | A * | 11/1992 | Wrobel | F21K 9/65 362/249.06 |
| 7,575,362 | B1 * | 8/2009 | Hsu | H01R 33/09 362/647 |
| 8,947,013 | B2 | 2/2015 | Sutardja et al. | |
| 9,144,129 | B2 | 9/2015 | Munday et al. | |
| 9,784,417 | B1 * | 10/2017 | Springer | F21V 23/006 |
| 9,801,250 | B1 * | 10/2017 | Halliwell | F21K 9/238 |
| 2003/0214810 | A1 * | 11/2003 | Zhang | F21V 29/773 362/373 |
| 2009/0045715 | A1 * | 2/2009 | Shantha | F21K 9/232 313/51 |
| 2011/0095687 | A1 * | 4/2011 | Jonsson | F21K 9/232 315/51 |

(Continued)

*Primary Examiner* — Anabel Ton

(57) ABSTRACT

A light emitting diode module comprises a bulb, a body attached to the bulb, and a base attached to the body. The base comprises a receptacle configured to receive an electrical connector and the body comprises at least one light emitting diode. The body can include a power supply that controls the delivery of power to the light emitting diode. One or more tabs can extend from the base and can secure the electrical connector to the module when the electrical connector is attached to the receptacle. The base can also include a sidewall that is flexible and that can be extended or contracted to meet the dimensions or needs of a luminaire.

19 Claims, 7 Drawing Sheets

(56) References Cited

U.S. PATENT DOCUMENTS

| | | | | |
|---|---|---|---|---|
| 2011/0163683 | A1* | 7/2011 | Steele | F21V 21/00 315/192 |
| 2012/0127692 | A1* | 5/2012 | Chien | F21V 19/00 362/84 |
| 2013/0271981 | A1* | 10/2013 | Hussell | F21V 19/003 362/235 |
| 2014/0049963 | A1* | 2/2014 | McGuire | F21V 19/04 362/382 |
| 2016/0245462 | A1* | 8/2016 | Demuynck | F21K 9/232 |
| 2018/0288847 | A1* | 10/2018 | Halliwell | F21K 9/65 |
| 2019/0230324 | A1* | 7/2019 | Chien | F21V 14/02 |

* cited by examiner

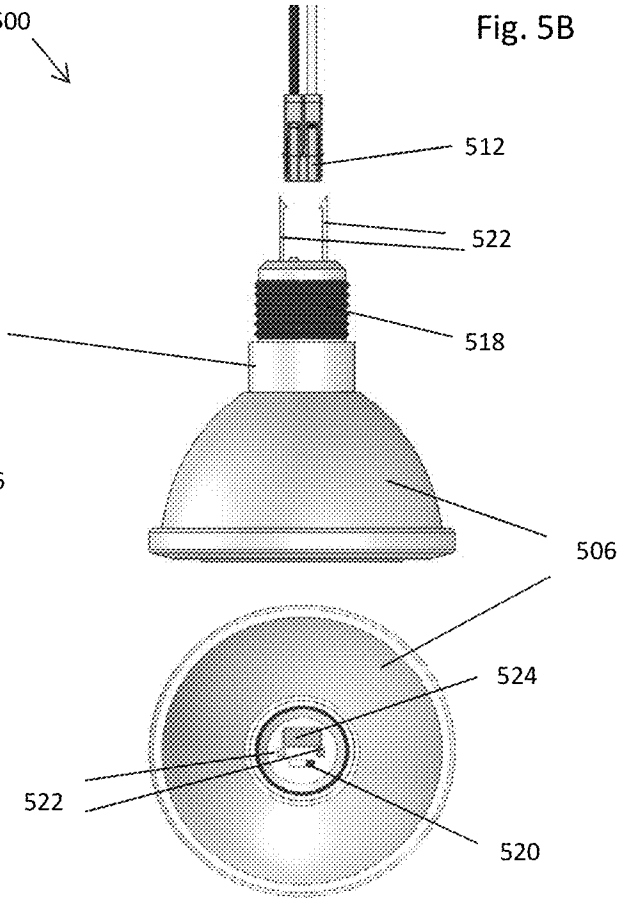
Fig. 5B
Fig. 5C
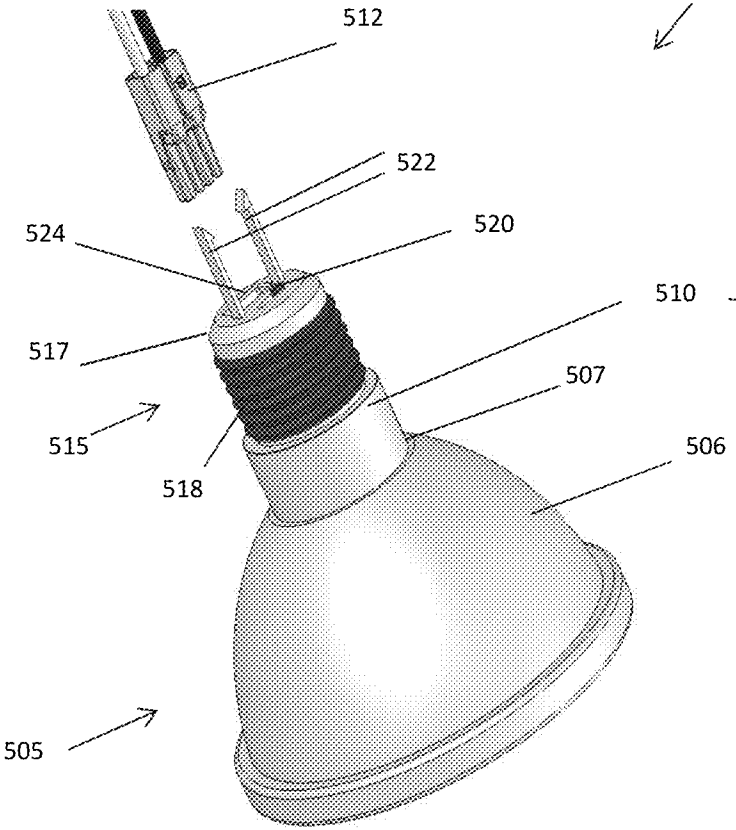
Fig. 5A

LIGHT BULB SHAPED LIGHT EMITTING DIODE MODULE

RELATED APPLICATIONS

The present application claims priority to U.S. Provisional Patent Application No. 62/807,178 filed Feb. 18, 2019 and titled "Light Bulb Shaped Light Emitting Diode Module," the contents of which are incorporated herein by reference.

TECHNICAL FIELD

Embodiments of the technology relate generally to a light emitting diode module in the shape of a light bulb.

BACKGROUND

The adoption of light emitting diode ("LED") light sources continues to grow because of the long life, energy efficiency, and unique features of LED light sources as compared to conventional light sources such as incandescent or fluorescent light sources. However, implementing LED light sources can also present challenges.

FIG. 1 illustrates an example of a typical construction site 100 that is lit using conventional incandescent light bulbs 105. As can be seen in FIG. 1, during construction when temporary lighting is needed, incandescent bulbs 105 are often inserted into conventional Edison base lighting sockets, such as an E26 socket, and the sockets are attached to electrical wiring 110 that hangs down into the construction site. As the construction is finalized, the temporary lighting will typically be replaced by lighting fixtures, such as a surface mounted or recessed lighting fixture.

The wider adoption of LED light sources in general has included adoption of LED light sources as a temporary light source during construction. In some jurisdictions, the use of energy efficient light sources, such as LED light sources, for temporary lighting during construction is required by local building codes. In a renovation or retrofitting context, the conventional lighting socket (such as an Edison base socket) and the supporting trim are removed and discarded and replaced with an integral LED retrofit module. In cases of new construction, LED light source based fixtures are installed which have an electrical connector typically used with an LED light source, such as the CJT type of connector 212 shown extending from the can 202 of the recessed light fixture housing 200 in FIG. 2. FIG. 3 illustrates an example of a construction site 300 with CJT connectors 312 hanging from recessed housings 302 installed in a ceiling. Conventional LED light modules 315 are attached to the CJT connectors 312 and hang down from the recessed housing 302 for temporary lighting during construction. In comparing FIG. 3 and FIG. 1, it can be seen the conventional LED light modules 315 are heavier, more complex, and more expensive than a conventional incandescent bulb. The conventional LED light modules 315 shown in FIG. 3 include an LED light source and a trim, and in some cases can include other components such as a lens. Arranging the LED light modules 315 to hang down from the recessed housings 302 for temporary lighting during construction as shown in FIG. 3 presents problems because of the greater weight, complexity and expense of the LED light modules 315. For example, in the hanging position shown in FIG. 3, the LED light modules 315 are exposed and have a greater likelihood of being damaged when they hang down from the ceiling outside of the recessed housing 302 as shown in FIG. 3.

Additionally, the CJT connector 312 may not provide sufficient support for the weight of the LED light module 315.

One or more of the foregoing shortcomings can be addressed with the example embodiments described in the following text and accompanying figures.

SUMMARY

The present disclosure is directed to a light bulb shaped light emitting diode module. In one example embodiment, the light emitting diode module comprises a bulb, a body attached to the bulb, and a base attached to the body. The body comprises a light emitting diode and the base comprises a receptacle configured to receive an electrical connector. The body can further comprise a driver or power supply that controls the delivery of power to the light emitting diode. One or more tabs can extend from the base and can secure the electrical connector to the module when the electrical connector is attached to the receptacle. The base can also include a sidewall that is flexible and that can be extended or contracted to meet the dimensions or needs of a luminaire.

These and other aspects, objects, features, and embodiments will be apparent from the following description and the appended claims.

BRIEF DESCRIPTION OF THE FIGURES

The drawings illustrate only example embodiments and are therefore not to be considered limiting of the scope of this disclosure. The elements and features shown in the drawings are not necessarily to scale, emphasis instead being placed upon clearly illustrating the principles of the example embodiments. Additionally, certain dimensions or positions may be exaggerated to help visually convey such principles.

FIGS. 5A, 5B, and 5C are perspective, side and top views, respectively, of an LED module in accordance with another example embodiment of the present disclosure.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments discussed herein are directed to a light emitting diode module ("LED module"). As described herein, the LED module can have a shape corresponding to an ANSI light bulb type so that the LED module can be used more easily in both LED luminaries and to retrofit luminaries with conventional light bulbs. Benefits associated with the LED module described herein can include, but are not limited to, simpler installation and adjustment of an LED module, greater ease of use as temporary lighting for construction sites, and the capability to meet one or more air tight standards. While the example embodiments described herein relate to recessed luminaries, the example embodiments can be applied to a variety of indoor and outdoor lighting systems, including in homes, offices, schools, garages, stadiums, warehouses, and a variety of other buildings and environments.

Figure 1:
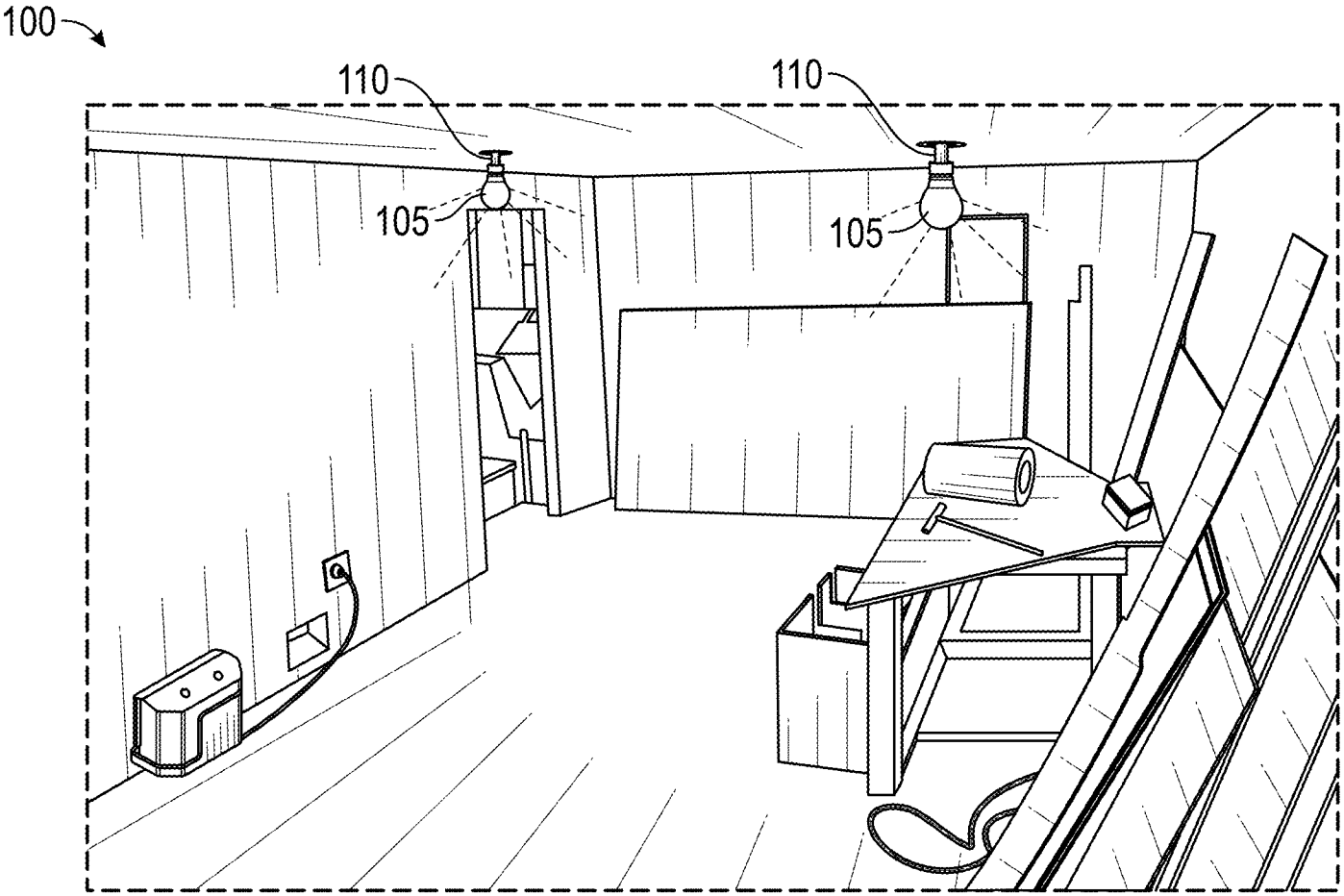
FIG. 1 (Prior Art)
FIG. 1 is an image of a construction site with temporary lighting using incandescent bulbs in accordance with the prior art.
Figure 2:
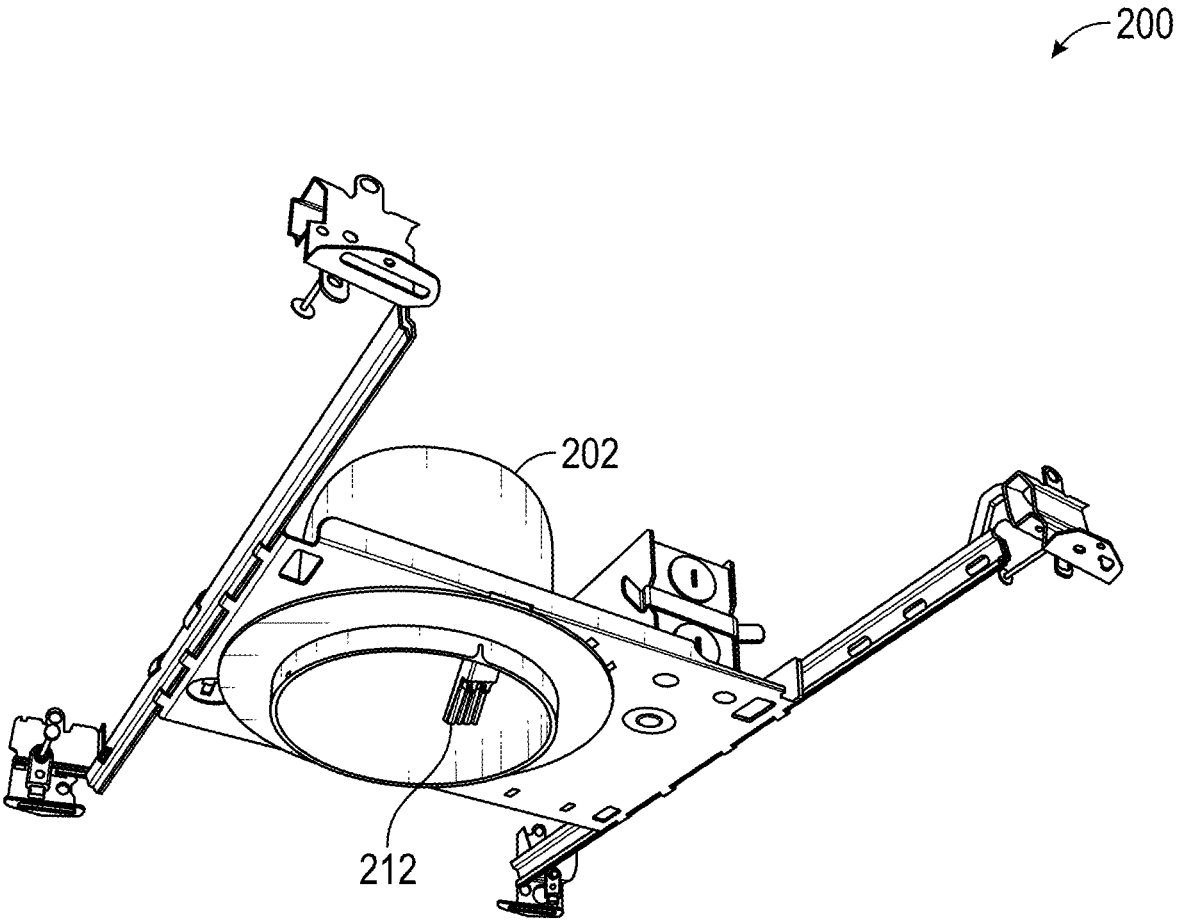
FIG. 2 (Prior Art)
FIG. 2 is an image of a recessed luminaire housing as is known in the prior art.
Figure 3:
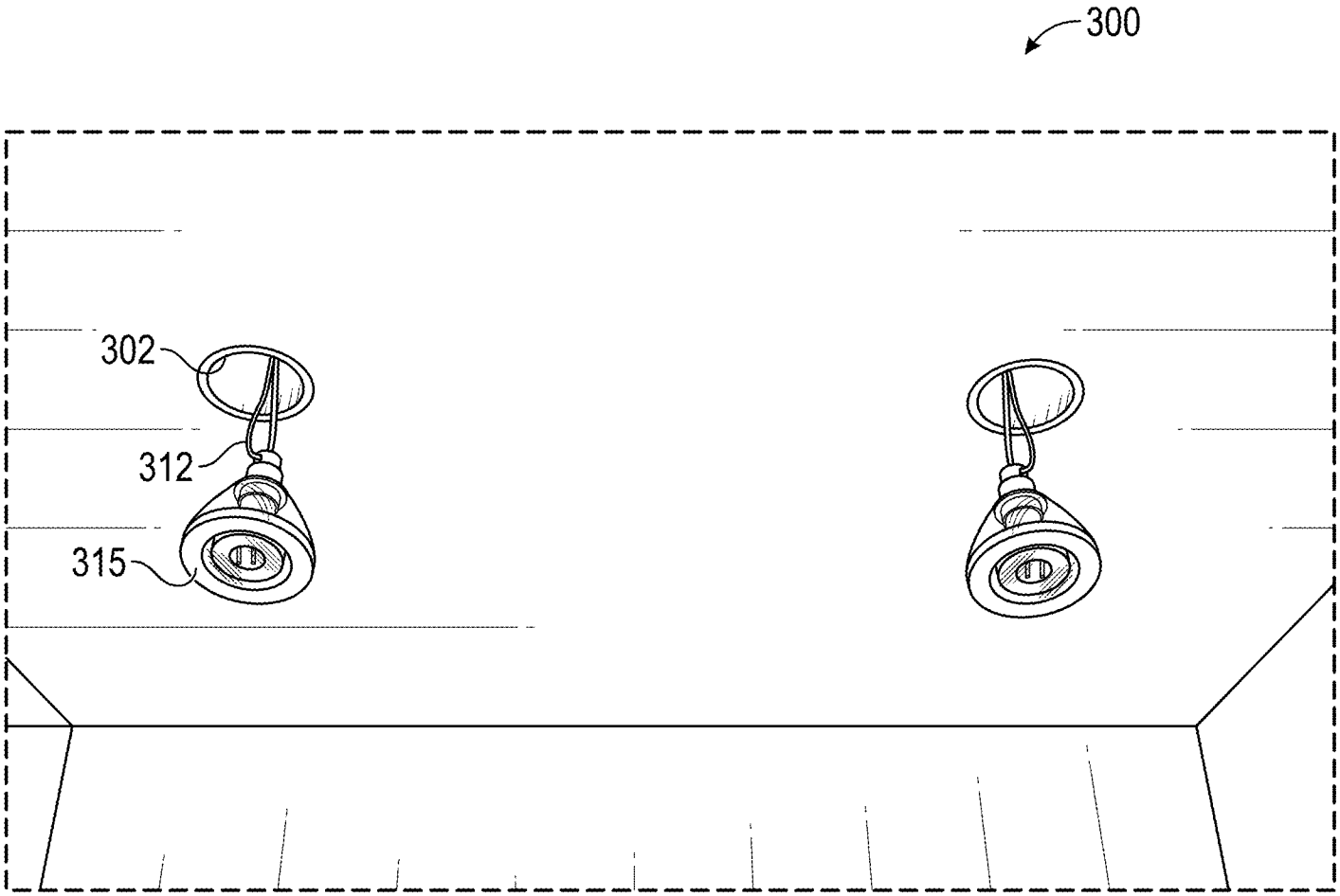
FIG. 3 (Prior Art)
FIG. 3 is an image of a construction site with temporary lighting using LED modules in accordance with the prior art.
Figures 4A, 4B, 4C:
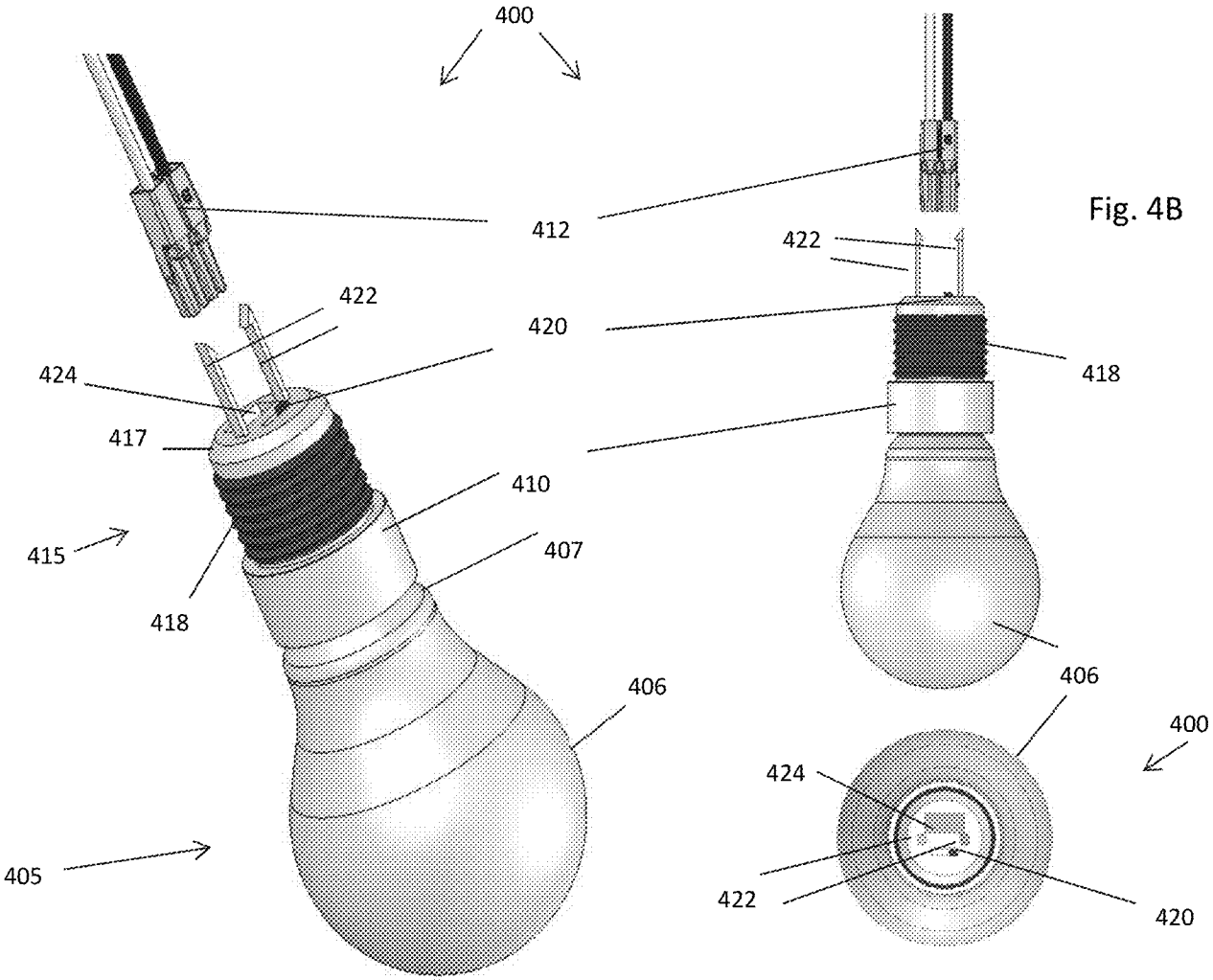
FIGS. 4A, 4B, and 4C are perspective, side and top views, respectively, of an LED module in accordance with an example embodiment of the present disclosure.

Referring to FIGS. 4A, 4B, and 4C (collectively "FIG. 4"), images of a perspective view, side view, and top view, respectively, of an LED module in accordance with the embodiments of this disclosure are provided. As shown in FIG. 4, the LED module 400 comprises a bulb 405, a body 410, and a base 415. The bulb 405 has a shape corresponding to an ANSI light bulb type, in this case an A15 or A19 bulb. The bulb can be made from a translucent material, such as glass or a plastic, and comprises a head 406 and a neck 407. The neck 407 of the bulb 405 attaches to a body 410 and the neck 407 and body 410 can have generally cylindrical shapes. The body 410 can contain one or more LED light sources and a driver (or more generally a power supply) for controlling the current supplied to the one or more LED light sources. Alternatively, the LEDs or the driver can be located in the neck 407 or can be located in both the body 410 and the neck 407. The one or more LEDs can be oriented to emit light toward the head 406 of the bulb 405. In other embodiments, other components such as a wireless transceiver or a processor can be located in the body 410 and/or the neck 407.

The driver or power supply can comprise one or more components generally known to those of skill in this field for providing a regulated power to a light emitting diode. For example, the power supply can comprise a transformer, an AC to DC converter, or a switched mode power supply. In alternate embodiments, the power supply can be located external to the LED module.

The body 410 of the LED module 400 is attached to the base 415. The base 415 comprises a seat 417 that is attached to a sidewall 418. As shown in FIG. 4, the sidewall 418 can comprise a flexible construction, such as a construction similar to a bellows or an accordion shape, and can comprise a flexible material such as rubber or thermoplastic. The flexible construction of the sidewall 418 allows a telescoping motion whereby the bulb 405 can be adjusted to be closer or farther from the seat 417. The adjustability of the sidewall 418 is useful in positioning the LED module 400 within luminaries and trims of varying shape and size so that the bulb is centered or positioned as desired. In certain example embodiments, the sidewall 418 is made of a compressible material, such as rubber, and can also serve as a gasket for creating an air tight seal between the LED module 400 and the luminaire trim or housing in which it is inserted. In some example applications, it can be desirable for a recessed luminaire to satisfy one or more air tight standards specifying the amount of air that is able to pass through the luminaire, for example, for energy efficiency purposes related to heating and cooling.

The seat 417 comprises one or more tabs 422 extending from the seat 417 in a direction opposite to the direction of the bulb 405. The tabs 422 provide a mechanical means for fastening the LED module 400 to connector 412. The tabs 422 can have a flange at one end for mechanically attaching to the connector 412. Although two tabs 422 are illustrated in FIG. 4, alternate embodiments can have one tab or more than one tab. Additionally, in alternate embodiments, the one or more tabs 422 can be eliminated or can be replaced with other mechanical fasteners.

The seat 417 also comprises a receptacle 424 configured to receive an electrical connector 412, such as the CJT type of connector illustrated in FIG. 4. The receptacle 424 is a recess in the seat 417 in which are located electrical contacts for delivering power from the electrical connector 412 to the driver and/or other components within the LED module 400. For example, the electrical connector 412 can provide AC line voltage to the LED module 400 and a power supply or driver within the LED module can convert the AC line voltage to DC power for use by the one or more LEDs. When the electrical connector 412 is inserted into the receptacle 424, the tabs 422 can fit along the sides of the electrical connector 412 so that flanges on the end of the tabs 422 wrap around the back side of the electrical connector 412 and secure the electrical connector to the LED module. The positions of the receptacle 424 and the tabs 422 on the seat 417 facilitate a simple installation of the LED module into a luminaire and secure the LED module within the luminaire. However, it should be understood that the receptacle 424 and the tabs 422 can have a variety of shapes, forms, and positions to accommodate other types of electrical connectors.

Lastly, the seat 417 comprises a selector switch 420 that permits control of a parameter associated with the LED module 400. For example, the selector switch could have connections to different LEDs located within the LED module 400, thereby permitting adjustment of a correlated color temperature or of the lumens emitted from the LED module 400. As another example, the LED module 400 can comprise a transceiver for wireless communication with a remote controller and the selector switch 420 can permit selection among different radio frequency communication protocols so that the LED module 400 is capable of communicating with different controllers. The position of the selector switch 420 allows a user to set one of the parameters when initially installing the LED module 400 and the parameter can easily be adjusted at a later point by removing the LED module 400 and adjusting the selector switch 420. It should be understood that the selector switch 420 can take a variety of forms, including but not limited to, a DIP switch, a rocker switch, a rotary switch, a push button switch, and a slider switch. In alternate embodiments, the selector switch can be located at other positions such as on the sidewall 418, on the body 410, or on the neck 407.

Referring now to FIGS. 5A, 5B, and 5C (collectively "FIG. 5"), images of another example embodiment of an LED module in accordance with the present disclosure is shown. Most of the components shown in example LED module 500 are similar to the components previously described in connection with example LED module 400 and analogous components are indicated by the same last two reference number digits. It should be assumed that the analogous components illustrated in FIG. 5 operate in a similar manner to the corresponding components of FIG. 4 and a detailed description will not be repeated.

Briefly, LED module 500 comprises a bulb 505 having a head 506 and a neck 507. The neck 507 of the bulb 505 attaches to a body 510, which in turn attaches to a base 515. One or more LEDs and other electrical components, such as a power supply, can be located within the body 510 or the base 515. The base 515 comprises a sidewall 518 and a seat 517. As with the example of FIG. 4, the sidewall 518 can have a flexible construction that permits extension or retraction of the LED module within a luminaire. The seat 517 comprises a receptacle 524 for receiving an electrical connector 512. One or more tabs 522 can extend from the seat 517 in a direction opposite to the bulb 505 and the one or more tabs 522 can be configured to secure the electrical connector 512 in the receptacle 524. For example, as shown in FIG. 5, the tabs 522 can comprise flanges at the ends of the tab farthest from the bulb 505 and the flanges can wrap around and secure the electrical connector 512 in the receptacle 524. In certain embodiments, the LED module 500 can also comprise a selector switch 520 which can be used to control power deliver to different LEDs within the LED module 500, thereby permitting control of correlated color temperature or light intensity. In other embodiments, the selector switch 520 can control other functions, such as a radio transmission protocol for a radio transceiver located within the LED module 500. Although the selector switch 520 is shown located on the seat 517, in alternate embodiments the selector switch can be located at other positions on the LED module 500.

Figure 8:
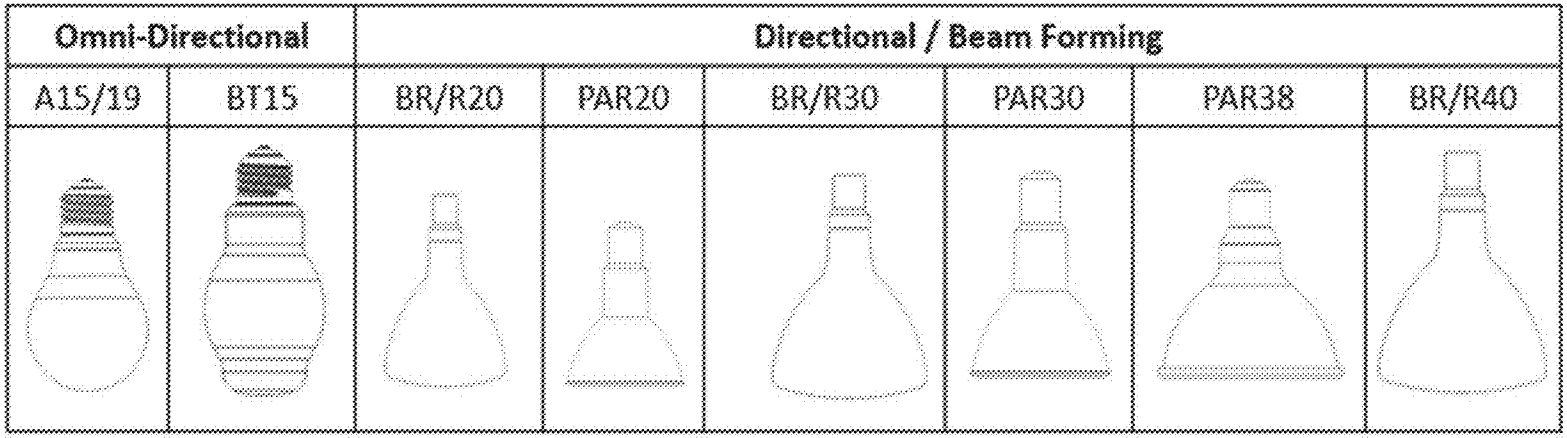
FIG. 8 illustrates examples of ANSI light bulb types.

LED module 500 is different from the previous example in that the shape of the bulb corresponds to the directional or beam forming ANSI bulb types such as type PAR 30. In example LED module 500, the head 506 of the bulb 505 has a different shape in that it comprises a substantially flat front face and a substantially conical sidewall. The interior of the substantially conical sidewall can include a reflective coating that receives a portion of the light emitted by the one or more LEDs within the LED module 500 and redirects that portion of the light toward the substantially flat front face for emission from the LED module 500. It should be understood that the bulb shapes shown in FIGS. 4 and 5 are examples and in other embodiments of the LED module, the bulb can have other shapes. For example, the bulb of the LED module can correspond with any of the standard ANSI shapes shown in FIG. 8.

Figure 7:
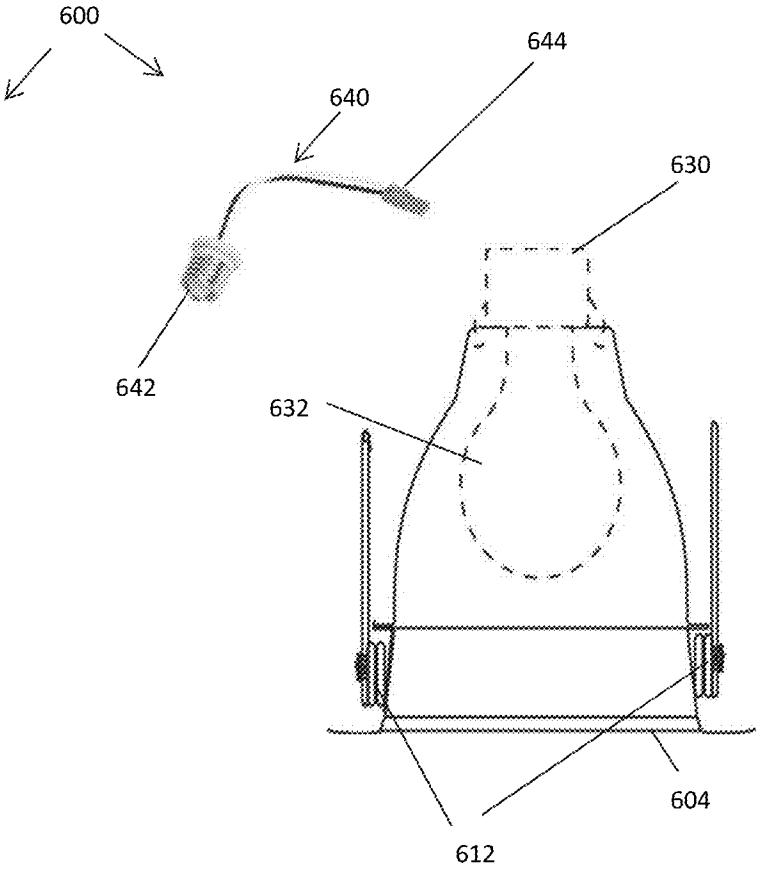
FIGS. 6 and 7 illustrate retrofitting a conventional luminaire with an LED module in accordance with the example embodiments of the present disclosure.
Figure 6:
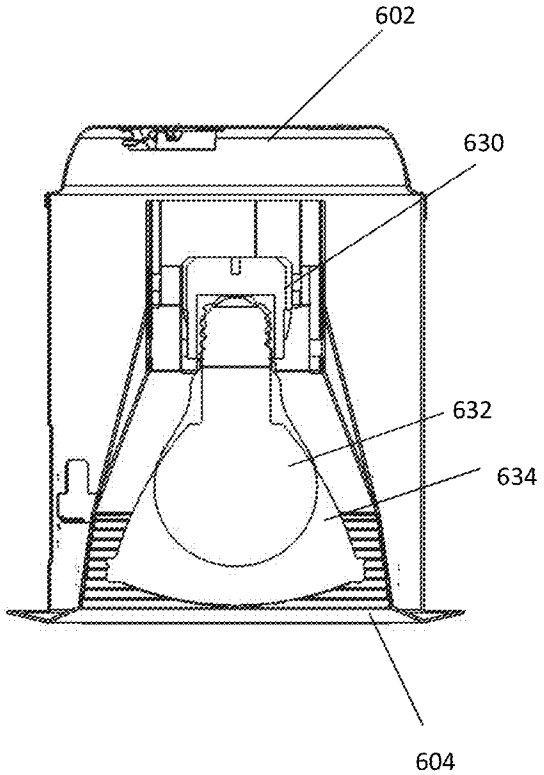

FIGS. 6 and 7 illustrate use of the example LED module in a retrofit application. In FIG. 6, a conventional luminaire 600 is illustrated comprising a housing can 602, a trim 604, and a conventional Edison base socket 630. For illustrative purposes only, two different conventional Edison base bulbs 632 and 634 are shown superimposed on each other in FIG. 6. It should be understood that in practice, two bulbs would not be positioned in the same Edison base socket simultaneously. In the illustration in FIG. 7, the housing can 602 has been eliminated in order to simplify the illustration and torsion springs 612 are visible on either side of the trim 604. FIG. 7 also shows the Edison base socket 630 and the Edison base bulb 632 in dotted lines for illustrative purposes. In a retrofit application, the Edison base bulb 632 can be removed and adapter 640 can be installed. That is, the Edison screw connector 642 of adapter 640 can be installed in the existing Edison base socket 630. The opposite end of the adapter 640 has a connector 644, such as the CJT type connector described previously. An LED module of the present disclosure, such as LED module 400 or 500, can be attached so that the connector 644 is inserted into the receptacle in the base of the LED module and then the LED module can be positioned within the trim 604. If the height of the LED module within the trim 604 requires adjustment, the previously described flexible sidewall of the base of the LED module can be extended or compressed to adjust the position of the LED module.

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

In certain example embodiments, the example luminaries and light emitting diode modules described herein are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures. Use of example embodiments described herein meet (and/or allow a corresponding device to meet) such standards when required.

Referring generally to the foregoing examples, any luminaire or light emitting diode module components (e.g., the tabs, the base, the body, a housing), described herein can be made from a single piece (e.g., as from a mold, injection mold, die cast, 3-D printing process, extrusion process, stamping process, or other prototype methods). In addition, or in the alternative, a luminaire or light emitting diode module (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

A fastener or attachment feature (including a complementary attachment feature) as described herein can allow one or more components and/or portions of an example luminaire to become coupled, directly or indirectly, to another portion or other component of a luminaire. An attachment feature can include, but is not limited to, a flange, a snap, Velcro, a clamp, a portion of a hinge, an aperture, a recessed area, a protrusion, a slot, a spring clip, a tab, a detent, and mating threads. A component can be coupled to a luminaire by the direct use of one or more attachment features.

In addition, or in the alternative, a portion of a luminaire can be coupled using one or more independent devices that interact with one or more attachment features disposed on the light fixture or a component of the light fixture. Examples of such devices can include, but are not limited to, a pin, a hinge, a fastening device (e.g., a bolt, a screw, a rivet), epoxy, glue, adhesive, tape, and a spring. One attachment feature described herein can be the same as, or different than, one or more other attachment features described herein. A complementary attachment feature (also sometimes called a corresponding attachment feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light emitting diode module comprising:

a bulb;

a body attached to the bulb, the body comprising a light emitting diode;

a power supply that controls the delivery of power to the light emitting diode; and a base attached to the body, the base comprising a receptacle configured to slidably receive an electrical connector along an axis defined by a height of the base, wherein the base comprises a seat and a sidewall.

2. The light emitting diode module of claim 1, wherein the base further comprises a tab for attaching the base to the electrical connector.

3. The light emitting diode module of claim 2, wherein the tab includes a flange for snap fitting the tab onto the electrical connector.

4. The light emitting diode module of claim 1, wherein the base further comprises a selector switch with a plurality of positions.

5. The light emitting diode module of claim 4, wherein each position of the plurality of positions of the selector switch is configured to modify power to the light emitting diode.

6. The light emitting diode module of claim 4, wherein each position of the plurality of positions of the selector switch is associated with a different color temperature output from the light emitting diode module.

7. The light emitting diode module of claim 4, wherein each position of the plurality of positions of the selector switch is associated with a different lumen output from the light emitting diode module.

8. The light emitting diode module of claim 4, wherein each position of the plurality of positions of the selector switch is associated with a different radio frequency communication protocol for a transceiver disposed in the light emitting diode module.

9. The light emitting diode module of claim 1, wherein the bulb has one of the following American National Standards Institute shapes: A15/19, BT15, BR/R20, PAR20, BR/R30, PAR30, PAR38, and BR/R40.

10. The light emitting diode module of claim 1, wherein the bulb comprises a reflective portion.

11. The light emitting diode module of claim 1, wherein the receptacle is a recess disposed in the seat of the base.

12. The light emitting diode module of claim 1, wherein an attachment tab extends from the seat in a direction away from the bulb.

13. The light emitting diode module of claim 1, wherein a selector switch is disposed on the seat of the base.

14. The light emitting diode module of claim 13, wherein the selector switch is operable to adjust a parameter associated with the light emitting diode module.

15. The light emitting diode module of claim 14, wherein the parameter is one of a color temperature of light output by the light emitting diode module, an amount of lumens output by the light emitting diode module, and a radio frequency communication protocol associated with a transceiver disposed in the light emitting diode module.

16. A light emitting diode module comprising:

a bulb;

a body attached to the bulb, the body comprising a light emitting diode; and a base attached to the body, the base comprising a receptacle configured to receive an electrical connector, wherein the base comprises a sidewall that attaches to the body, and wherein the sidewall comprises a flexible construction that can be expanded or compressed.

17. A light emitting diode module comprising:

a bulb;

a body attached to the bulb, the body comprising a light emitting diode; and a base attached to the body, the base comprising a receptacle configured to receive an electrical connector, wherein the base comprises a sidewall that attaches to the body, wherein the sidewall comprises a flexible material that serves as a seal.

18. The light emitting diode module of claim 1, wherein the receptacle comprises a recess disposed in a seat of the base, wherein the seat is a distal surface of the base opposite the body.

19. The light emitting diode module of claim 1, wherein the body and the base are made from a single piece.

* * * * *